US011367407B2

(12) United States Patent
Ishii

(10) Patent No.: US 11,367,407 B2
(45) Date of Patent: Jun. 21, 2022

(54) DISPLAY DRIVER, DISPLAY DEVICE, AND SEMICONDUCTOR DEVICE TO DETECT FAULT IN FIXED DRIVING VOLTAGE APPLIED TO A DISPLAY PANEL

(71) Applicant: LAPIS Semiconductor Co., Ltd., Yokohama (JP)

(72) Inventor: Hiroaki Ishii, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 16/997,222

(22) Filed: Aug. 19, 2020

(65) Prior Publication Data

US 2021/0065639 A1 Mar. 4, 2021

(30) Foreign Application Priority Data

Aug. 30, 2019 (JP) ..... JP2019-158264

(51) Int. Cl.
*G09G 3/36* (2006.01)

(52) U.S. Cl.
CPC ..... *G09G 3/3614* (2013.01); *G09G 3/3688* (2013.01); *G09G 3/3696* (2013.01)

(58) Field of Classification Search
CPC ..... G09G 3/36; G09G 3/3611; G09G 3/3614; G09G 3/3622; G09G 3/3625; G09G 3/364; G09G 3/3688; G09G 3/3692
USPC ..... 345/87–104
See application file for complete search history.

(56) References Cited

U.S. PATENT DOCUMENTS 6,753,835 B1 * 6/2004 Sakai ..... G09G 3/3648 345/100
10,410,595 B2 * 9/2019 Ishii ..... G09G 3/3677
2008/0001870 A1 * 1/2008 Lee ..... G09G 3/3655 345/87
2009/0058780 A1 * 3/2009 Fukano ..... G09G 3/3655 345/90
2009/0121987 A1 * 5/2009 Fukutome ..... G09G 3/342 345/82
2012/0147195 A1 * 6/2012 Jang ..... G09G 5/363 348/180
2014/0218272 A1 * 8/2014 Kikuchi ..... G09G 3/3258 345/77

(Continued)

FOREIGN PATENT DOCUMENTS

JP 2018-040963 A 3/2018

*Primary Examiner* — Alexander Eisen
*Assistant Examiner* — Nelson Lam
(74) *Attorney, Agent, or Firm* — Rabin & Berdo, P.C.

(57) ABSTRACT

A display driver according to the present invention includes a control part and a fault detection circuit. The control part sequentially incorporates first fault detection data and second fault detection data into a video signal during non-display periods of the video signal. The fault detection circuit binarizes each of a first pixel driving voltage and a second pixel driving voltage with a predetermined threshold voltage to obtain a first signal and a second signal. The first pixel driving voltage is generated based on the first fault detection data. The second pixel driving voltage is generated based on the second fault detection data. The fault detection circuit determines whether the first signal and the second signal match and outputs a fault detection signal that indicates a presence of a fault when the first signal and the second signal match.

6 Claims, 15 Drawing Sheets

(56) References Cited

U.S. PATENT DOCUMENTS

| | | | | |
|---|---|---|---|---|
| 2014/0329339 | A1* | 11/2014 | Chaji | G09G 3/006 438/10 |
| 2015/0187335 | A1* | 7/2015 | Sugiyama | G09G 3/2014 345/208 |
| 2016/0055785 | A1* | 2/2016 | Kondo | G09G 3/20 345/690 |
| 2020/0084437 | A1* | 3/2020 | Feekes | H04N 5/2258 |

* cited by examiner

DISPLAY DRIVER, DISPLAY DEVICE, AND SEMICONDUCTOR DEVICE TO DETECT FAULT IN FIXED DRIVING VOLTAGE APPLIED TO A DISPLAY PANEL

This application claims the benefit of Japan Application No. 2019-158264, filed on Aug. 30, 2019. The entirety of the above-mentioned patent application is hereby incorporated by reference herein and made a part of this specification.

BACKGROUND

1. Technical Field

The present invention relates to a display driver that drives a display panel on the basis of a video signal, a display device, and a semiconductor device that includes the display driver.

2. Related Art

A source driver that drives a liquid crystal display panel and the like as a display panel inverts a polarity of a driving voltage applied to a plurality of source lines of the liquid crystal display panel for each pixel, each display line, or each one frame period to suppress a burn-in of the liquid crystal display panel. Specifically, a source driver receives a polarity inversion signal sent from a control part, and inverts a polarity of a driving voltage applied to source lines of a liquid crystal display panel in response to the polarity inversion signal.

Incidentally, recently, a vehicle that employs such a liquid crystal display panel as an on-vehicle electron mirror has appeared. Therefore, for ensuring safety of traveling, when a fault occurs in the source driver that drives the liquid crystal display panel, the fault needs to be quickly detected and notified to an occupant of the vehicle.

Accordingly, there has been proposed a display driver that has a function to detect a fault of a polarity inversion signal as described above (see, for example, JP-A-2018-40963). The display driver includes a polarity inversion abnormality detection part that determines an occurrence of an abnormality in a wiring that transmits the polarity inversion signal when the polarity inversion signal indicates one constant polarity for a period of N frames.

SUMMARY

While the display driver disclosed in JP-A-2018-40963 can detect the fault of the polarity inversion signal itself, the display driver cannot detect a fault of a circuit that performs a process corresponding to the polarity inversion signal or its subsequent circuit, for example, a fault of an output amplifier or a D/A converter that generates a driving voltage applied to each source line.

That is, the display driver cannot detect a fault in which a voltage value of the driving voltage applied to each source line is fixed in spite that a video signal indicating a video image is supplied.

Therefore, it is an object of the present invention to provide a display driver, a display device, and a semiconductor device that have a function to detect a fault in which a driving voltage applied to each source line of a display panel is fixed.

A display driver according to the present invention receives a video signal, generates pixel driving voltages, and outputs the pixel driving voltages to a display panel. The video signal includes a series of pixel data pieces that indicate luminance levels of respective pixels. The pixel driving voltages correspond to the pixel data pieces. The display driver includes a control part and a fault detection circuit. The control part sequentially incorporates a first pixel data piece and a second pixel data piece for fault detection into non-display periods of the video signal. The fault detection circuit binarizes each of a first pixel driving voltage and a second pixel driving voltage with a predetermined threshold voltage to obtain a first signal and a second signal. The first pixel driving voltage is output corresponding to the first pixel data piece. The second pixel driving voltage is output corresponding to the second pixel data piece. The fault detection circuit determines whether the first signal and the second signal match and outputs a fault detection signal that indicates a presence of a fault when the first signal and the second signal match.

A display device according to the present invention includes a display driver that includes a control part and a fault detection circuit, and a display panel to which pixel driving voltages are input. The control part sequentially incorporates a first pixel data piece and a second pixel data piece for fault detection into non-display periods of a video signal. The video signal includes a series of pixel data pieces that indicate luminance levels of respective pixels. The fault detection circuit binarizes each of a first pixel driving voltage and a second pixel driving voltage with a predetermined threshold voltage to obtain a first signal and a second signal. The first pixel driving voltage is output corresponding to the first pixel data piece. The second pixel driving voltage is output corresponding to the second pixel data piece. The fault detection circuit determines whether the first signal and the second signal match and outputs a fault detection signal that indicates a presence of a fault when the first signal and the second signal match.

A semiconductor device according to the present invention includes a display driver that receives a video signal, generates pixel driving voltages, and outputs the pixel driving voltages to a display panel. The video signal includes a series of pixel data pieces that indicate luminance levels of respective pixels. The pixel driving voltages correspond to the pixel data pieces. The display driver includes a control part and a fault detection circuit. The control part sequentially incorporates a first pixel data piece and a second pixel data piece for fault detection into non-display periods of the video signal. The fault detection circuit binarizes each of a first pixel driving voltage and a second pixel driving voltage with a predetermined threshold voltage to obtain a first signal and a second signal. The first pixel driving voltage is output corresponding to the first pixel data piece. The second pixel driving voltage is output corresponding to the second pixel data piece. The fault detection circuit determines whether the first signal and the second signal match and outputs a fault detection signal that indicates a presence of a fault when the first signal and the second signal match.

In the present invention, first, the first and the second pixel data pieces for fault detection are sequentially incorporated in non-display periods of a video signal. In each of the non-display periods, the first pixel driving voltage outputted on the basis of the first pixel data piece and the second pixel driving voltage outputted on the basis of the second pixel data piece are each binarized with the predetermined threshold voltage to obtain first and second signals. At this time, when the fault in which the voltage value of the pixel driving voltage is fixed has occurred, the first and the second signals become same. Then, the fault detection circuit disposed to the display driver determines whether the first signal and the second signal match and outputs the fault detection signal that indicates the presence of the fault in the case of matching.

Accordingly, the fault in which the voltage value of the pixel driving voltage applied to each source line of the display panel is fixed can be detected while an ordinary display operation is executed.

DETAILED DESCRIPTION

The following describes embodiments of the present invention in detail with reference to the drawings.

Figure 1:
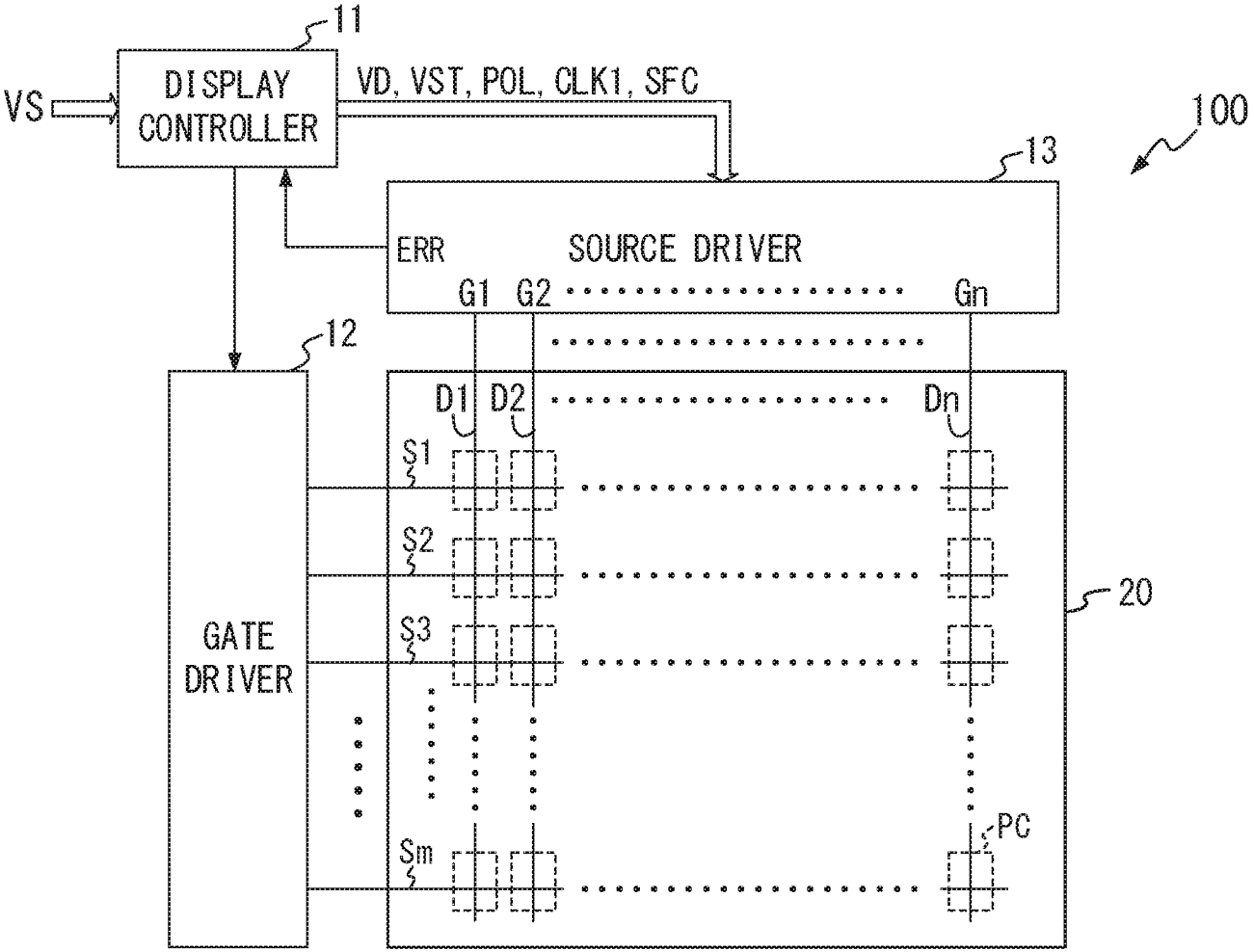
FIG. 1 is a block diagram illustrating a configuration of a display device that includes a display driver according to the present invention.

FIG. 1 is a block diagram illustrating a configuration of a display device 100 that includes a source driver as a display driver according to the present invention. As illustrated in FIG. 1, the display device 100 includes a display controller 11, a gate driver 12, a source driver 13 and a display panel 20.

The display panel 20 is an image display panel that includes, for example, a liquid crystal display panel. The display panel 20 includes horizontal scanning lines S1 to Sm (m is a natural number of two or more) that extend in a horizontal direction of a two-dimensional screen and source lines D1 to Dn (n is a natural number of two or more) that extend in a vertical direction of the two-dimensional screen. Regions of respective intersections between the horizontal scanning lines and the source lines, that is, regions surrounded by dashed lines in FIG. 1, include display cells PC that serve as pixels.

The display controller 11 generates a series of pixel data PD that indicates a luminance level of each pixel in a luminance gradation of, for example, 8 bits based on an input video signal VS, and supplies a video data signal VD that includes the series of the pixel data PD to the source driver 13.

The display controller 11 extracts a horizontal synchronization signal and a vertical synchronization signal from the input video signal VS. The display controller 11 generates a horizontal synchronization signal CLK1 of one horizontal scanning cycle in synchronization with the extracted horizontal synchronization signal, and supplies the horizontal synchronization signal CLK1 to the gate driver 12 and the source driver 13. The display controller 11 supplies a vertical synchronization signal SFC and a frame start signal VST, which are synchronized with the extracted vertical synchronization signal, to the source driver 13. The vertical synchronization signal SFC has a cycle same as that of the vertical synchronization signal. The frame start signal VST indicates a timing of a start of retrieving first pixel data PD of each frame period.

The display controller 11 supplies a binary polarity inversion signal POL to the source driver 13 in synchronization with the vertical synchronization signal extracted as described above. The polarity inversion signal POL has a signal level that changes from a state exhibiting negative polarity to a state exhibiting positive polarity (or vice versa) for each cycle of the vertical synchronization signal.

Figure 2:
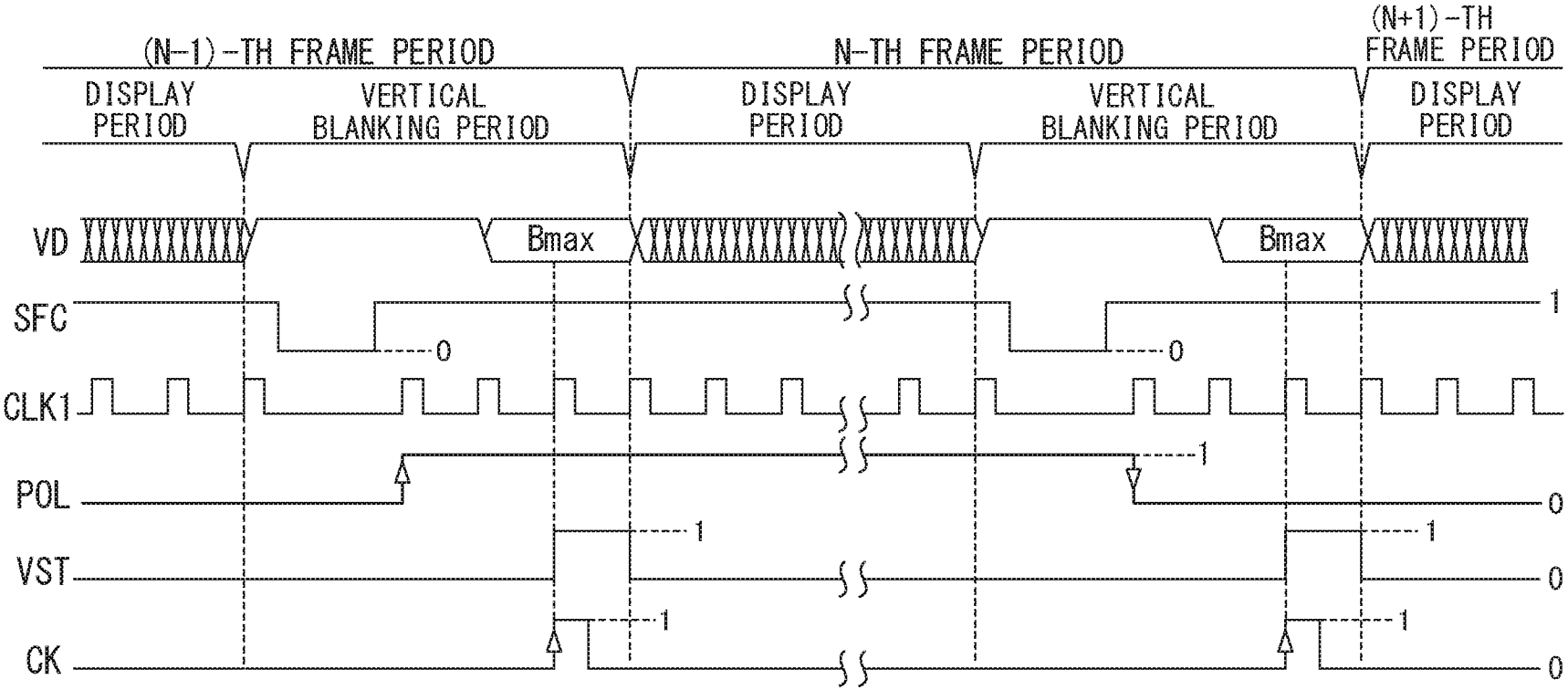
FIG. 2 is a timing chart illustrating exemplary waveforms of a vertical synchronization signal, a horizontal synchronization signal, a polarity inversion signal, and a frame start signal generated by a display controller.

FIG. 2 is a timing chart illustrating exemplary waveforms of the video data signal VD, the vertical synchronization signal SFC, the horizontal synchronization signal CLK1, the polarity inversion signal POL, and the frame start signal VST, which are sent from the display controller 11 to the source driver 13.

As illustrated in FIG. 2, the video data signal VD includes the series of the pixel data PD that carries an image of one frame in a display period excluding a vertical blanking period in each frame period.

The vertical synchronization signal SFC is a binary signal that includes a pulse indicating a vertical synchronization timing in the vertical blanking period of each frame period, for example, one pulse in which a state of a logic level 1 transitions to a logic level 0 and returns to the state of the logic level 1 again.

The horizontal synchronization signal CLK1 is a binary signal in which a state of the logic level 0 transitions to a state of the logic level 1 (or vice versa) for each horizontal scanning period H excluding a period in which the vertical synchronization signal SFC keeps the logic level 0.

The polarity inversion signal POL is a binary signal in which a state of the logic level 0 transitions to the logic level 1, or the state of the logic level 1 transitions to the logic level 0 only once in each vertical blanking period.

The frame start signal VST is a binary signal that becomes a state of the logic level 1 only in a predetermined period after the inversion of the level of the polarity inversion signal POL in each vertical blanking period, and keeps a state of the logic level 0 in the other period.

The display controller 11 controls the source driver 13 to stop a display operation of the display panel 20 or to display a notification of a fault occurrence when a fault detection signal ERR is supplied from the source driver 13.

The gate driver 12 generates a horizontal scanning pulse in synchronization with the horizontal synchronization signal CLK1 supplied from the display controller 11, and sequentially applies the horizontal scanning pulse to each of the horizontal scanning lines S1 to Sm of the display panel 20.

The source driver 13 is disposed to a single semiconductor IC chip, or dispersedly disposed to a plurality of semiconductor IC chips. The source driver 13 converts the pixel data PD included in the video data signal VD into gradation voltages by every n pieces in response to the horizontal synchronization signal CLK1 and the frame start signal VST, and the gradation voltages have voltage values corresponding to luminance levels indicated by the respective n pieces of the pixel data PD. Then, the source driver 13 inverts the polarities of the respective n gradation voltages in response to the polarity inversion signal POL in each frame period, and supplies the voltages, which are each individually amplified, as pixel driving voltages G1 to Gn to the source lines D1 to Dn of the display panel 20.

When a fault occurs inside the source driver 13, the source driver 13 detects the fault and generates the fault detection signal ERR, and supplies the fault detection signal ERR to the display controller 11.

Figure 3:
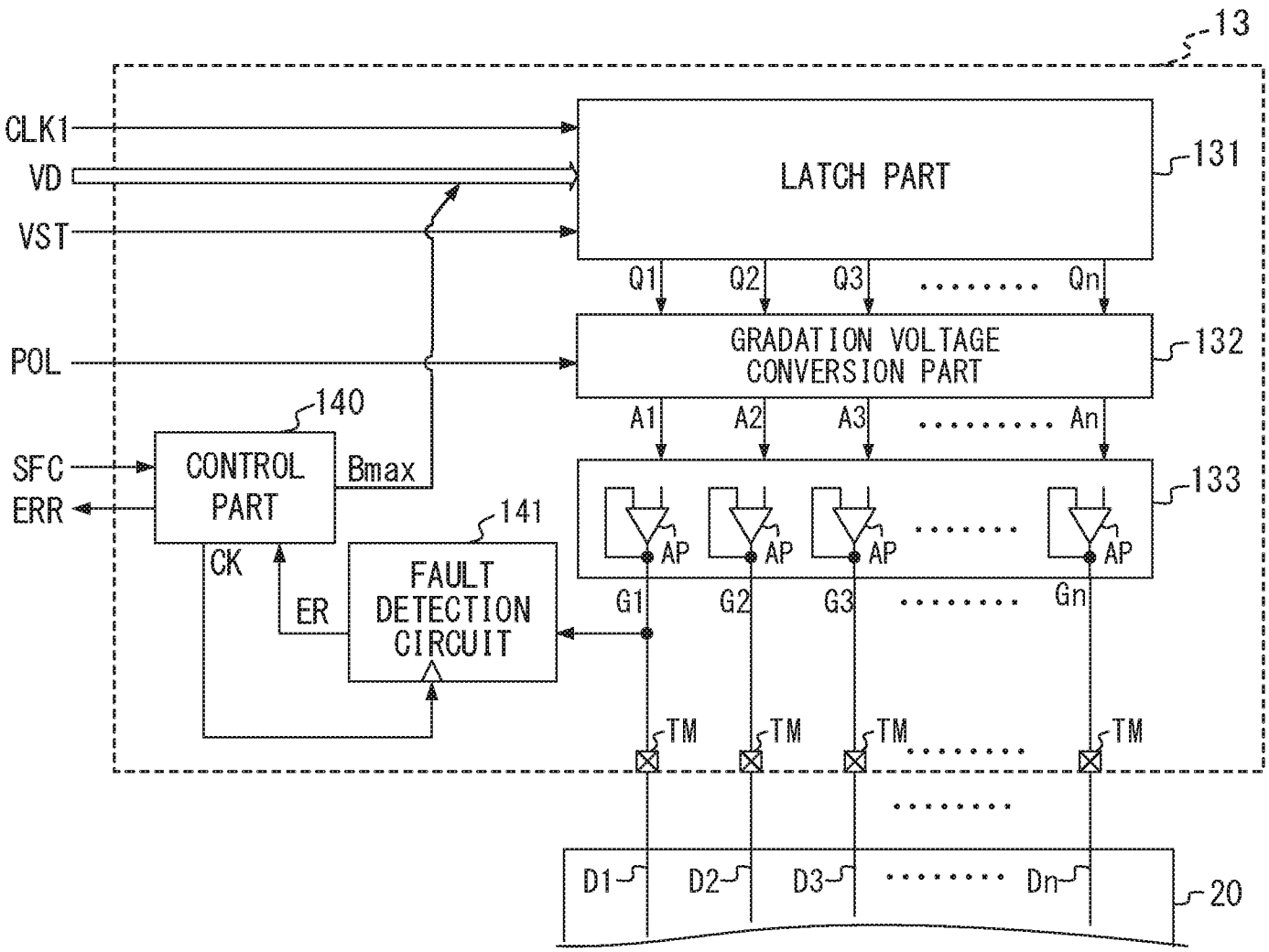
FIG. 3 is a block diagram illustrating an internal configuration of a source driver as the display driver according to the present invention.

FIG. 3 is a block diagram illustrating an internal configuration of the source driver 13.

As illustrated in FIG. 3, the source driver 13 includes a latch part 131, a gradation voltage conversion part 132, an output part 133, a control part 140, and a fault detection circuit 141.

The latch part 131 sequentially retrieves each piece of the pixel data PD of one frame included in the video data signal VD at timings synchronized with the horizontal synchronization signal CLK1 in response to the frame start signal VST. The latch part 131 supplies the n pieces of the pixel data PD as pixel data Q1 to Qn to the gradation voltage conversion part 132 every time when the n pieces of the pixel data PD corresponding to one horizontal scanning line are acquired.

The gradation voltage conversion part 132 converts the respective pixel data Q1 to Qn into the gradation voltages that have voltage values corresponding to the luminance levels indicated by the pixel data Q. The gradation voltage conversion part 132 obtains the n gradation voltages as respective gradation voltages A1 to An by converting the pixel data Q1 to Qn as described above. The gradation voltage conversion part 132 inverts the polarities of the respective gradation voltages A1 to An from the positive polarity to the negative polarity, or from the negative polarity to the positive polarity in response to the polarity inversion signal POL.

For example, while the polarity inversion signal POL of the logic level 0 is supplied, the gradation voltage conversion part 132 sets the respective odd numbered gradation voltages among the gradation voltages A1 to An to the gradation voltages having the voltage values of the positive polarity, and sets the respective even numbered gradation voltages to the gradation voltages having the voltage values of the negative polarity. Then, when the polarity inversion signal POL transitions from the logic level 0 to the logic level 1, the gradation voltage conversion part 132 inverts the polarities of the respective odd numbered gradation voltages among the gradation voltages A1 to An to the negative polarity, and inverts the polarities of the respective even numbered gradation voltages to the positive polarity.

The gradation voltage conversion part 132 supplies the gradation voltages A1 to An, to which such a polarity inversion process has been performed, to the output part 133.

The output part 133 includes n output amplifiers AP, which are operational amplifiers and the like, to individually amplify each of the gradation voltages A1 to An. The output part 133 outputs voltages, which are output from these n output amplifiers AP, as the pixel driving voltages G1 to Gn to outside the source driver 13 via respective external terminals TM.

The control part 140 supplies the video data signal VD, into which pixel data Bmax for fault detection is incorporated, to the latch part 131 in response to the vertical synchronization signal SFC during each vertical blanking period as illustrated in FIG. 2. The pixel data Bmax is equivalent to pixel data that indicates, for example, the maximum luminance level in 8 bits.

The control part 140 generates a clock signal CK having the same cycle as the vertical synchronization signal SFC in synchronization with the vertical synchronization signal SFC, and supplies the clock signal CK to the fault detection circuit 141. The control part 140 generates a pulse-shaped signal, which transitions from a state of the logic level 0 to the logic level 1 after the output of the pixel driving voltage G1 based on the pixel data Bmax in each vertical blanking period as illustrated in FIG. 2, as the clock signal CK described above.

Furthermore, when the control part 140 receives a fault detection signal ER from the fault detection circuit 141, the control part 140 once holds the fault detection signal ER in a built-in register (not illustrated). Then, in response to a request from the outside of the source driver 13, the control part 140 outputs the fault detection signal held in the built-in register as the fault detection signal ERR to the outside of the source driver 13. In the configuration illustrated in FIG. 1, the fault detection signal ERR is supplied to the display controller 11.

The fault detection circuit 141 detects the fault that has occurred in the gradation voltage conversion part 132 or the output part 133 on the bases of the clock signal CK and the pixel driving voltage G1 output from the output part 133, and supplies the fault detection signal ER indicating the detection result to the control part 140.

Figure 4:
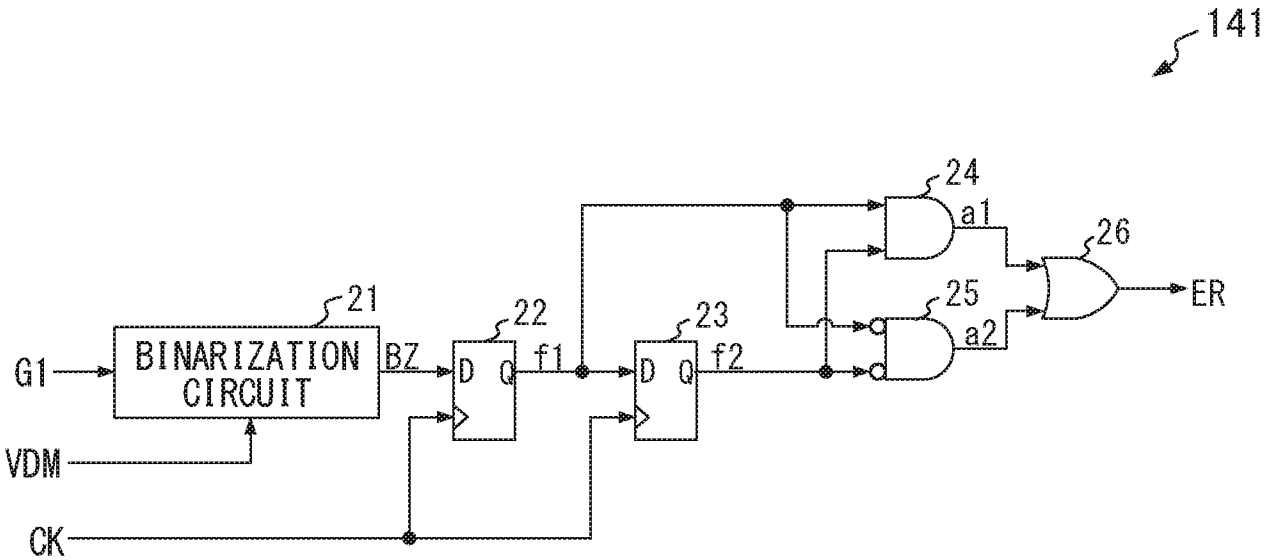
FIG. 4 is a circuit diagram illustrating an exemplary fault detection circuit.

FIG. 4 is a circuit diagram illustrating an exemplary internal configuration of the fault detection circuit 141.

As illustrated in FIG. 4, the fault detection circuit 141 includes a binarization circuit 21, D-type flip-flops 22 and 23

(hereinafter referred to as FF 22 and FF 23), an AND gate 24, a NOR gate 25, and an OR gate 26.

The binarization circuit 21 receives the pixel driving voltage G1 and a threshold voltage VDM that is a threshold when binarizing the pixel driving voltage G1. The threshold voltage VDM has an intermediate voltage value between the maximum voltage value of the positive polarity and the minimum voltage value of the negative polarity that are possible as the pixel driving voltages (G1 to Gn) output from the source driver 13. That is, the threshold voltage VDM has a voltage value at a boundary between the voltage of the positive polarity and the voltage of the negative polarity.

The binarization circuit 21 determines whether the voltage value of the pixel driving voltage G1 is equal to or more than the threshold voltage VDM and supplies the FF 22 with a binarized signal BZ of the logic level 0 when it is equal to or more than the threshold voltage VDM or more and a binarized signal BZ of the logic level 1 when it is less than the threshold voltage VDM.

The FF 22 retrieves and holds the binarized signal BZ at a timing of a rising edge of the clock signal CK. The FF 22 supplies the holding binarized signal BZ to the FF 23, the AND gate 24 and the NOR gate 25 as a first signal f1 that indicates whether the pixel driving voltage of a first frame is equal to or more than the threshold voltage VDM or not.

The FF 23 retrieves and holds the first signal f1 at the timing of the rising edge of the clock signal CK. The FF23 supplies the holding first signal f1 to the AND gate 24 and the NOR gate 25 as a second signal f2 that indicates whether the pixel driving voltage of a second frame following the above-described first frame is equal to or more than the threshold voltage VDM or not.

The AND gate 24 supplies the OR gate 26 with a first fault determination signal a1 of the logic level 1 indicating "presence of fault" when both the first signal f1 and the second signal f2 are the logic level 1. The AND gate 24 supplies the OR gate 26 with the first fault determination signal a1 of the logic level 0 when at least one of the first signal f1 and the second signal f2 is the logic level 0.

The NOR gate 25 supplies the OR gate 26 with a second fault determination signal a2 of the logic level 1 indicating "presence of fault" when both the first signal f1 and the second signal f2 are the logic level 0. The NOR gate 25 supplies the OR gate 26 with the second fault determination signal a2 of the logic level 0 when at least one of the first signal f1 and the second signal f2 is the logic level 1.

The OR gate 26 outputs the fault detection signal ER of the logic level 0 indicating "no fault" when both the first and the second fault determination signals a1 and a2 are the logic level 0. Meanwhile, the OR gate 26 outputs the fault detection signal ER of the logic level 1 indicating "presence of fault" when at least one of the first and the second fault determination signals a1 and a2 is the logic level 1 indicating "presence of fault."

With this configuration, as illustrated in FIG. 2, first, the fault detection circuit 141 determines whether the voltage value (polarity) of the pixel driving voltage G1 output from the output part 133 has changed in each vertical blanking period in continuous two frame periods or not. The fault detection circuit 141 generates the fault detection signal ER indicating "no fault" when the voltage value (polarity) of the pixel driving voltage G1 has changed in the continuous two frame periods, and the fault detection signal ER indicating "presence of fault" when the polarity has not changed over the two frame periods. The fault detection circuit 141 supplies the fault detection signal ER to the control part 140.

The following describes a fault detection process by the control part 140 and the fault detection circuit 141 dividing into a case where the fault has not occurred in the polarity inversion signal POL or the output part 133, a case where the fault has occurred in the polarity inversion signal POL, and a case where the fault has occurred in the output part 133.

Figure 5:
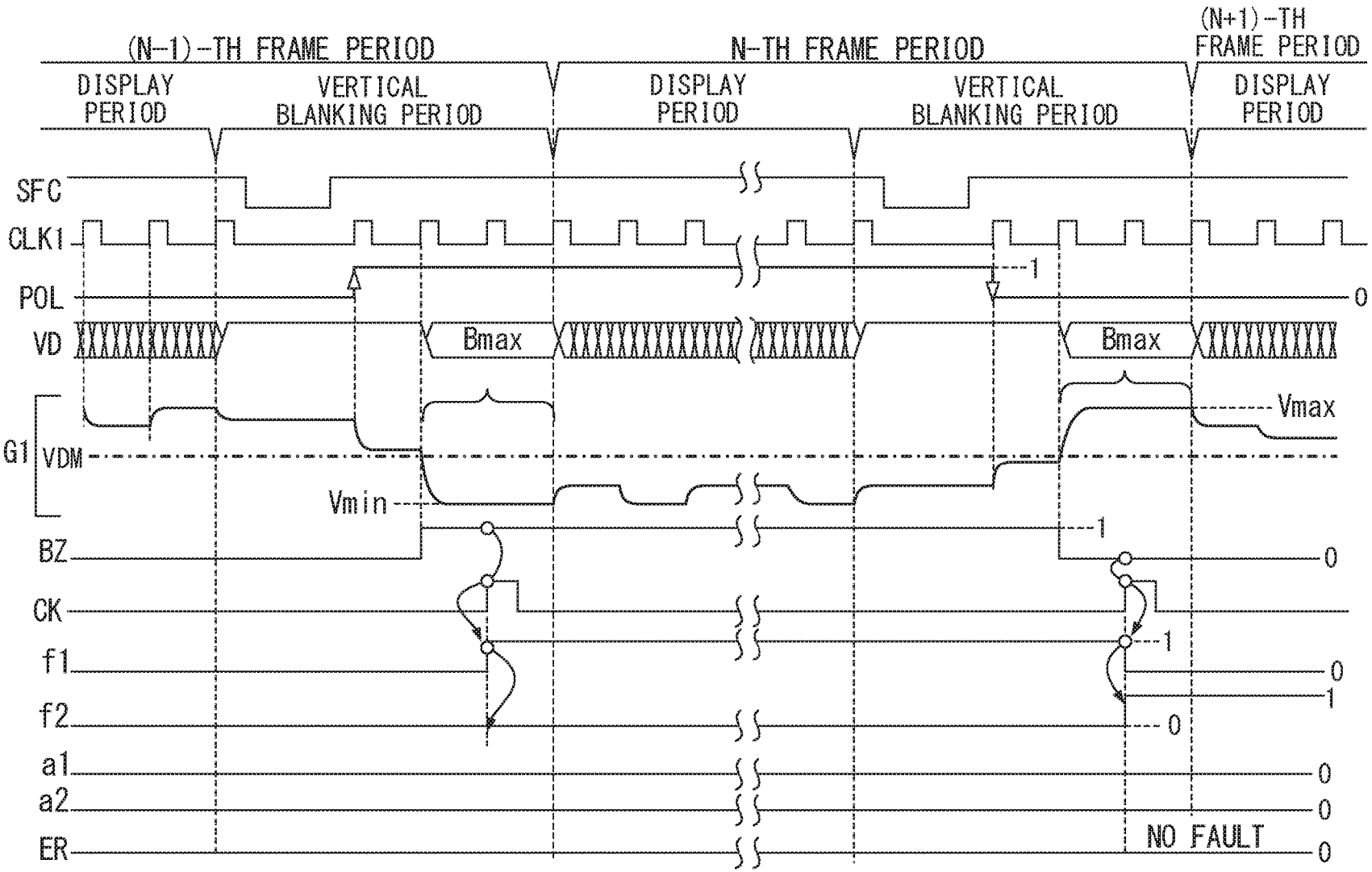
FIG. 5 is a timing chart illustrating exemplary waveforms of various signals in the source driver and the fault detection circuit when a fault has not occurred.

FIG. 5 is a timing chart illustrating exemplary waveforms of the respective signals in the source driver 13 and the fault detection circuit 141 when the fault has not occurred in the polarity inversion signal POL or the output part 133.

As illustrated in FIG. 5, when the fault has not occurred in the polarity inversion signal POL, the logic level of the polarity inversion signal POL is inverted only once in each vertical blanking period. When the fault has not occurred in the output part 133, the pixel driving voltage G1 output from the output part 133 becomes the voltage of the positive polarity higher than the threshold voltage VDM while the polarity inversion signal POL is, for example, the logic level 0 as illustrated in FIG. 5. While the polarity inversion signal POL is the logic level 1, as illustrated in FIG. 5, the pixel driving voltage G1 becomes the voltage of the negative polarity lower than the threshold voltage VDM.

The control part 140 supplies the latch part 131 with the pixel data Bmax for fault detection that has the highest luminance level as the video data signal VD in each vertical blanking period as illustrated in FIG. 5. Thus, the value of the pixel driving voltage G1 based on the pixel data Bmax transitions from the minimum voltage value Vmin of the negative polarity to the maximum voltage value Vmax of the positive polarity between respective vertical blanking periods (referred to as first and second vertical blanking periods) of continuous (N−1)-th (N is an integer of two or more) and N-th frame periods as illustrated in FIG. 5. Accordingly, the logic level of the binarized signal BZ obtained by binarizing the pixel driving voltage G1 with the threshold voltage VDM by the binarization circuit 21 of the fault detection circuit 141 is inverted in each of the first and the second vertical blanking periods as illustrated in FIG. 5.

Accordingly, the first signal f1 obtained by retrieving the binarized signal BZ at a timing of the clock signal CK in the second vertical blanking period by the FF 22 of the fault detection circuit 141 and the second signal f2 obtained by retrieving the binarized signal BZ at a timing of the clock signal CK in the first vertical blanking period by the FF 23 are mutually different in logic level. Therefore, at this time, since both the AND gate 24 and the NOR gate 25 output the logic level 0, the fault detection circuit 141 outputs the fault detection signal ER of the logic level 0 indicating "no fault."

Figure 6:
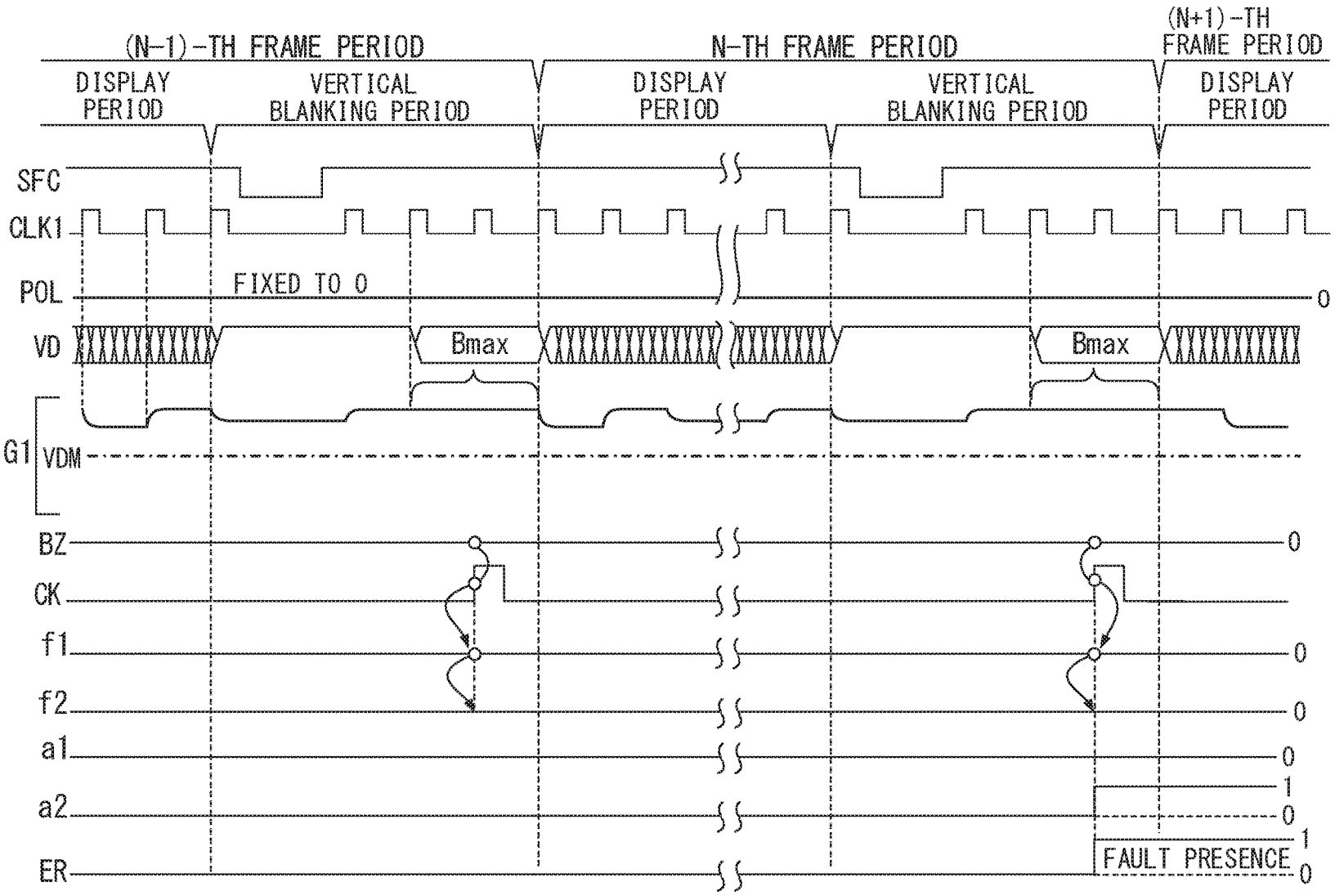
FIG. 6 is a timing chart illustrating exemplary waveforms of various signals in the source driver and the fault detection circuit when a fault in which the polarity inversion signal is fixed to a logic level 0 has occurred.

FIG. 6 is a timing chart illustrating exemplary waveforms of the respective signals in the source driver 13 and the fault detection circuit 141 when a fault in which the polarity inversion signal POL is fixed to the logic level 0 has occurred.

As illustrated in FIG. 6, when the fault in which the polarity inversion signal POL is fixed to the logic level 0 has occurred, the polarity inversion process to the gradation voltages A1 to An is not performed by the gradation voltage conversion part 132. At this time, as illustrated in FIG. 6, the pixel driving voltage G1 output from the output part 133 has the voltage value of the positive polarity constantly higher than the threshold voltage VDM. Therefore, the logic level of the binarized signal BZ obtained by binarizing the pixel driving voltage G1 with the threshold voltage VDM by the binarization circuit 21 is fixed to the state of the logic level 0 as illustrated in FIG. 6.

Accordingly, the first signal f1 obtained by retrieving the binarized signal BZ at the timing of the clock signal CK in the second vertical blanking period by the FF 22 becomes the logic level 0. The second signal f2 obtained by retrieving the binarized signal BZ at the timing of the clock signal CK in the first vertical blanking period by the FF 23 also becomes the logic level 0. That is, both the first signal f1 and the second signal f2 become the same logic level 0. Therefore, at this time, since the NOR gate 25 generates the fault determination signal a2 of the logic level 1, the fault detection circuit 141 outputs the fault detection signal ER of the logic level 1 indicating "presence of fault."

Figure 7:
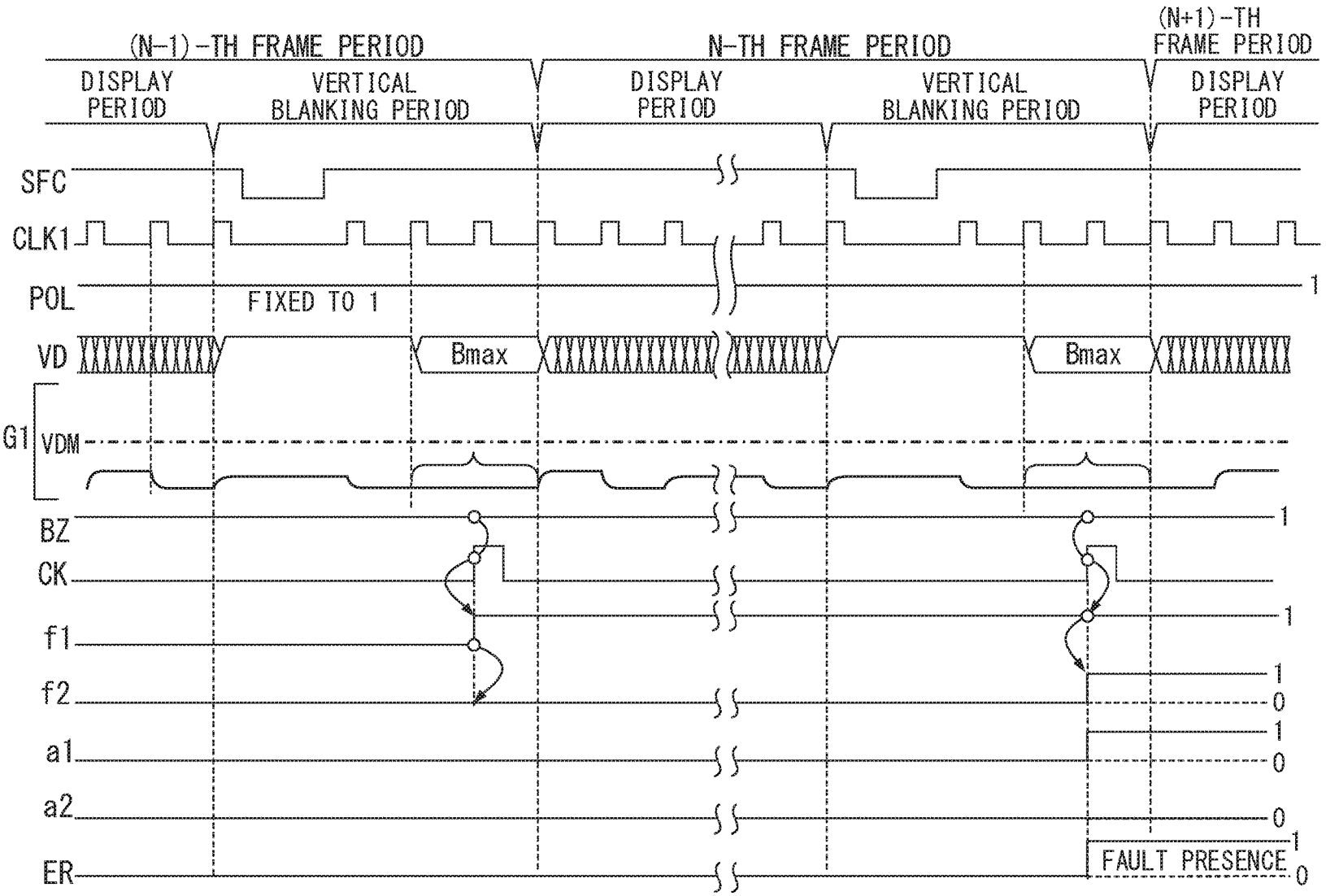
FIG. 7 is a timing chart illustrating exemplary waveforms of various signals in the source driver and the fault detection circuit when a fault in which the polarity inversion signal is fixed to a logic level 1 has occurred.

FIG. 7 is a timing chart illustrating exemplary waveforms of the respective signals in the source driver 13 and the fault detection circuit 141 when a fault in which the polarity inversion signal POL is fixed to the logic level 1 has occurred.

As illustrated in FIG. 7, when the fault in which the polarity inversion signal POL is fixed to the logic level 1 has occurred, the polarity inversion process to the gradation voltages A1 to An is not performed by the gradation voltage conversion part 132. At this time, as illustrated in FIG. 7, the pixel driving voltage G1 output from the output part 133 keeps the voltage value of the negative polarity lower than the threshold voltage VDM. Therefore, the logic level of the binarized signal BZ obtained by binarizing the pixel driving voltage G1 with the threshold voltage VDM by the binarization circuit 21 is fixed to the state of the logic level 1 as illustrated in FIG. 7.

Accordingly, the first signal f1 obtained by retrieving the binarized signal BZ at the timing of the clock signal CK in the second vertical blanking period by the FF 22 becomes the logic level 1. The second signal f2 obtained by retrieving the binarized signal BZ at the timing of the clock signal CK in the first vertical blanking period by the FF 23 also becomes the logic level 1. That is, both the first signal f1 and the second signal f2 become the same logic level 1. Therefore, at this time, since the AND gate 24 generates the fault determination signal a1 of the logic level 1, the fault detection circuit 141 outputs the fault detection signal ER of the logic level 1 indicating "presence of fault."

Figure 8:
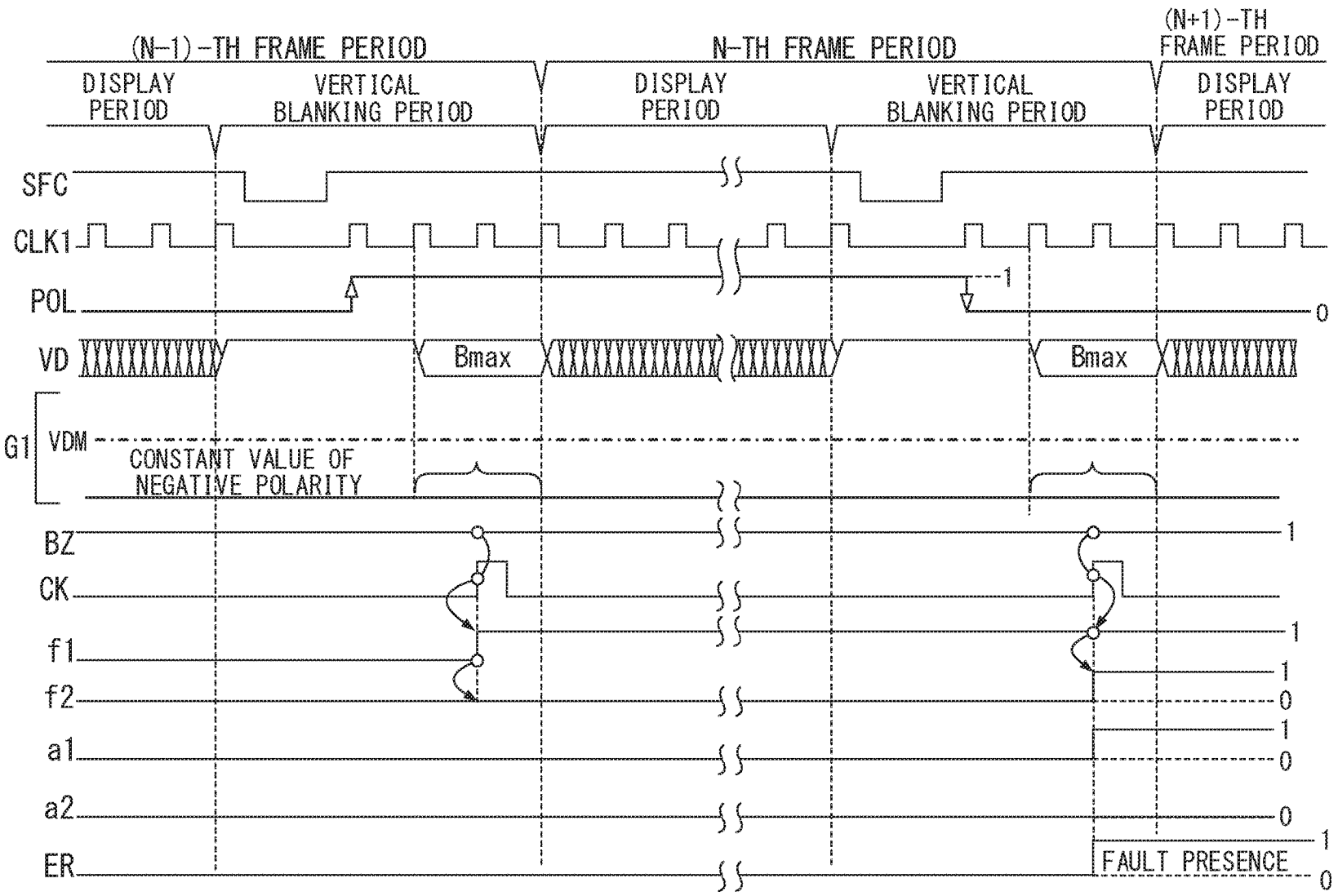
FIG. 8 is a timing chart illustrating exemplary waveforms of various signals in the source driver and the fault detection circuit when a fault in which a voltage value of a pixel driving voltage is fixed to a constant value of negative polarity has occurred.

FIG. 8 is a timing chart illustrating exemplary waveforms of the respective signals in the source driver 13 and the fault detection circuit 141 when a fault in which a voltage value of the pixel driving voltage G1 generated by the output part 133 is fixed to a constant value of the negative polarity has occurred.

As illustrated in FIG. 8, when such a fault has occurred, the pixel driving voltage G1 keeps the voltage value of the negative polarity lower than the threshold voltage VDM. Therefore, the logic level of the binarized signal BZ obtained by binarizing the pixel driving voltage G1 with the threshold voltage VDM by the binarization circuit 21 is fixed to the state of the logic level 1 as illustrated in FIG. 8.

Accordingly, the first signal f1 obtained by retrieving the binarized signal BZ at the timing of the clock signal CK in the second vertical blanking period by the FF 22 becomes the logic level 1. The second signal f2 obtained by retrieving the binarized signal BZ at the timing of the clock signal CK in the first vertical blanking period by the FF 23 also becomes the logic level 1. That is, both the first signal f1 and the second signal f2 become the same logic level 1. Therefore, at this time, since the AND gate 24 generates the fault determination signal a1 of the logic level 1, the fault detection circuit 141 outputs the fault detection signal ER of the logic level 1 indicating "presence of fault."

Figure 9:
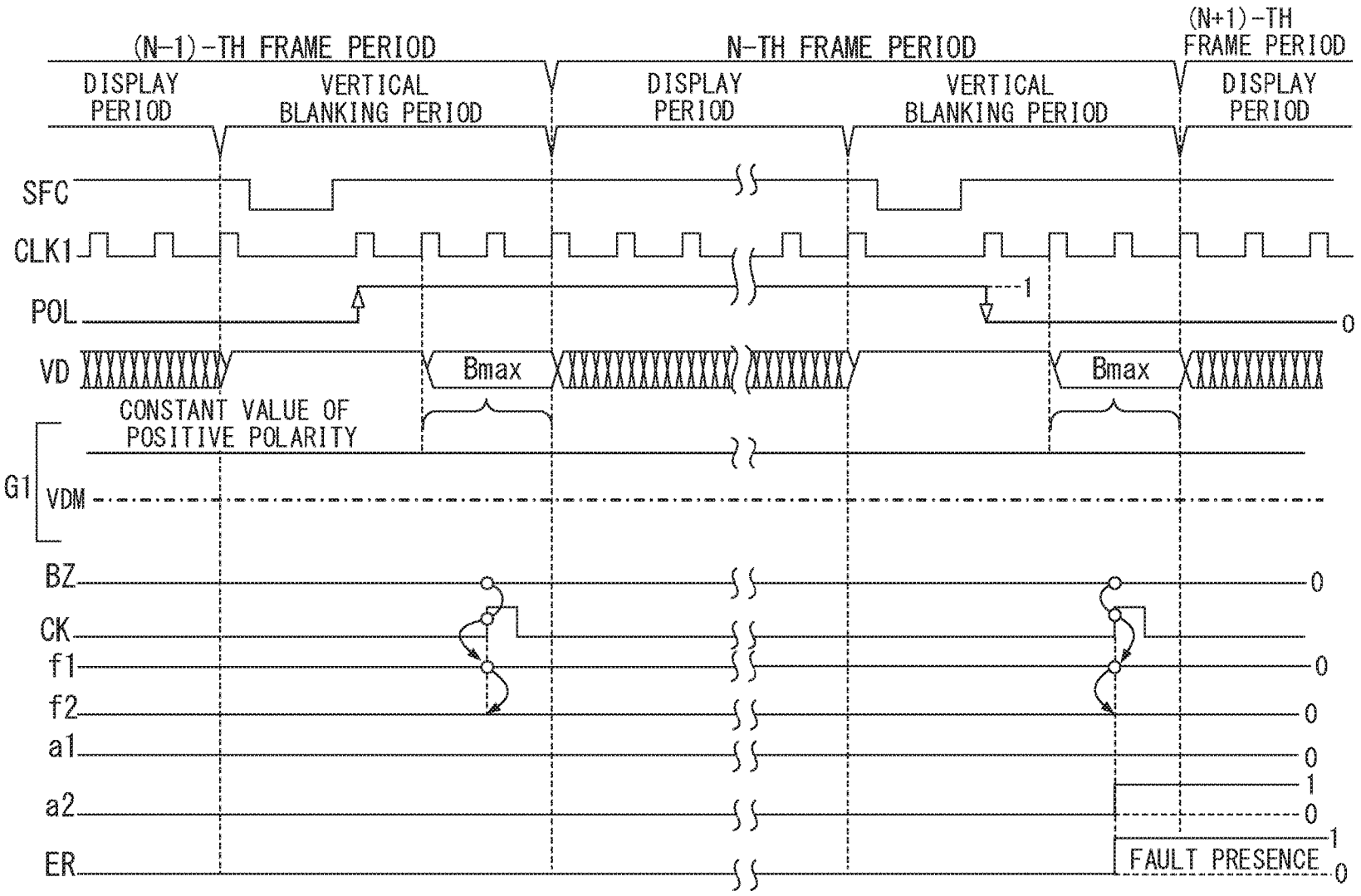
FIG. 9 is a timing chart illustrating exemplary waveforms of various signals in the source driver and the fault detection circuit when a fault in which the voltage value of the pixel driving voltage is fixed to a constant value of positive polarity has occurred.

FIG. 9 is a timing chart illustrating exemplary waveforms of the respective signals in the source driver 13 and the fault detection circuit 141 when a fault in which the voltage value of the pixel driving voltage G1 generated by the output part 133 is fixed to a constant value of the positive polarity has occurred.

As illustrated in FIG. 9, when such a fault has occurred, the pixel driving voltage G1 keeps the voltage value of the positive polarity higher than the threshold voltage VDM. Therefore, the logic level of the binarized signal BZ obtained by binarizing the pixel driving voltage G1 with the threshold voltage VDM by the binarization circuit 21 is fixed to the state of the logic level 0 as illustrated in FIG. 9.

Accordingly, the first signal f1 obtained by retrieving the binarized signal BZ at the timing of the clock signal CK in the second vertical blanking period by the FF 22 becomes the logic level 0. The second signal f2 obtained by retrieving the binarized signal BZ at the timing of the clock signal CK in the first vertical blanking period by the FF 23 also becomes the logic level 0. That is, both the first signal f1 and the second signal f2 become the same logic level 0. Therefore, at this time, since the NOR gate 25 generates the fault determination signal a2 of the logic level 1, the fault detection circuit 141 outputs the fault detection signal ER of the logic level 1 indicating "presence of fault."

As described above in detail, the source driver 13 can uses the control part 140 and the fault detection circuit 141 to detect not only the fault of the polarity inversion signal but also the fault in which the output of the source driver 13, that is, the pixel driving voltage is fixed, while performing the ordinary display operation.

That is, the control part 140 incorporates the pixel data Bmax as a first pixel data piece for the fault detection into the video data signal VD during the vertical blanking period (referred to as a first vertical blanking period) in the (N−1)-th frame period of the video data signal VD. Subsequently, the control part 140 incorporates the pixel data Bmax as a second pixel data piece for the fault detection into the video data signal VD during the vertical blanking period (referred to as a second vertical blanking period) in the N-th frame period following the (N−1)-th frame period. Accordingly, the source driver 13 generates a first pixel driving voltage G1 based on first pixel data Bmax during the first vertical blanking period, and generates a second pixel driving voltage G1 based on second pixel data Bmax during the second vertical blanking period.

The pixel driving voltage generated by the source driver 13 has the voltage value whose polarity is inverted in each frame period in response to the polarity inversion signal POL. Therefore, when the fault has not occurred, the voltage value of the pixel driving voltage G1 generated in the first vertical blanking period and the voltage value of the pixel driving voltage G1 generated in the second vertical blanking period are mutually different in polarity. Thus, both do not become same. However, when the fault in which the voltage value of the pixel driving voltage is fixed has occurred, the pixel driving voltage G1 generated in the first vertical blanking period and the pixel driving voltage G1 generated in the second vertical blanking period become mutually same.

Therefore, the fault detection circuit 141 obtains the first signal f1 by binarizing the first pixel driving voltage G1 generated in the first vertical blanking period with the threshold voltage VDM as described above. Further, the fault detection circuit 141 obtains the second signal f2 by binarizing the second pixel driving voltage G1 generated in the second vertical blanking period with the threshold voltage VDM. At this time, when the fault in which the output of the source driver 13, that is, the voltage value of the pixel driving voltage is fixed has occurred, the first signal f1 and the second signal f2 become same. Therefore, the AND gate 24, the NOR gate 25, and the OR gate 26 of the fault detection circuit 141 are configured to determine whether the first signal f1 and the second signal f2 match and output the fault detection signal ER of the logic level 1 indicating the presence of the fault when they match.

Accordingly, the control part 140 and the fault detection circuit 141 can detect not only the fault of the polarity inversion signal POL but also the fault in which the voltage value of the pixel driving voltage applied to the source lines of the display panel 20 is fixed due to the fault of the output part 133 or the gradation voltage conversion part 132.

In the above-described embodiment, the fault detection is performed using the polarity inversion of the pixel driving voltage performed in driving the liquid crystal display panel. However, also when driving an organic electro luminescence (EL) panel in which the polarity inversion is not performed, disposing the fault detection circuit 141 ensures detecting the fault in which the voltage value of the pixel driving voltage applied to the organic EL panel is fixed.

Figure 10:
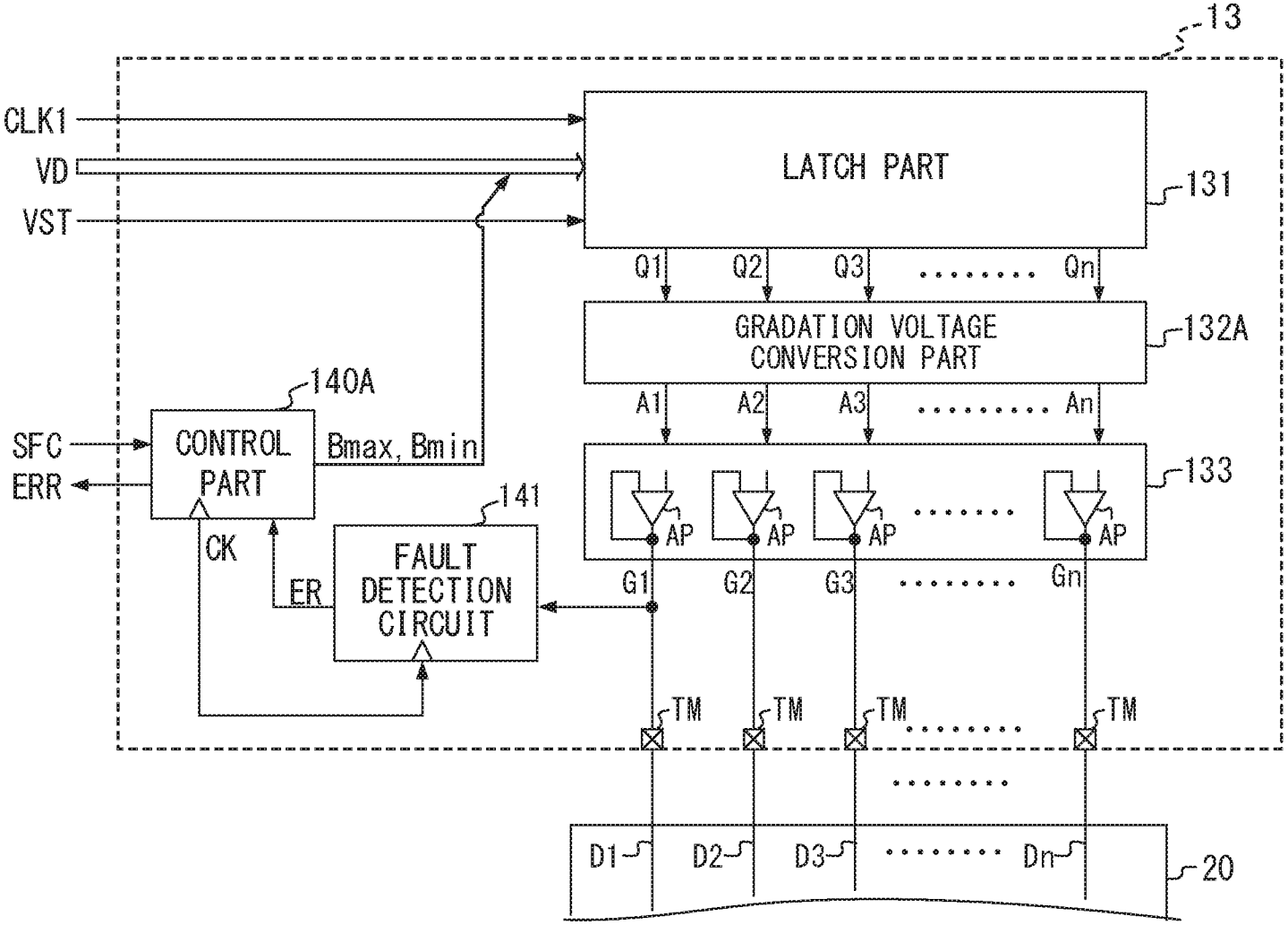
FIG. 10 is a block diagram illustrating another internal configuration of the source driver.

FIG. 10 is a block diagram illustrating another internal configuration of the source driver 13 in consideration of such a point. The configuration illustrated in FIG. 10 is same as that of FIG. 3 excluding that a gradation voltage conversion part 132A is employed instead of the gradation voltage conversion part 132 and a control part 140A is employed instead of the control part 140.

The operations of the gradation voltage conversion part 132A are same as the operations of the above-described gradation voltage conversion part 132 excluding that the polarity inversion function to invert the polarity of the gradation voltage in response to the polarity inversion signal POL is omitted.

The control part 140A once holds the fault detection signal ER in a built-in register when receiving the fault detection signal ER from the fault detection circuit 141, similarly to the control part 140 illustrated in FIG. 3. In response to a request from the outside of the source driver 13, the control part 140A outputs the fault detection signal held in the built-in register as the fault detection signal ERR to the outside of the source driver 13.

Figure 11:
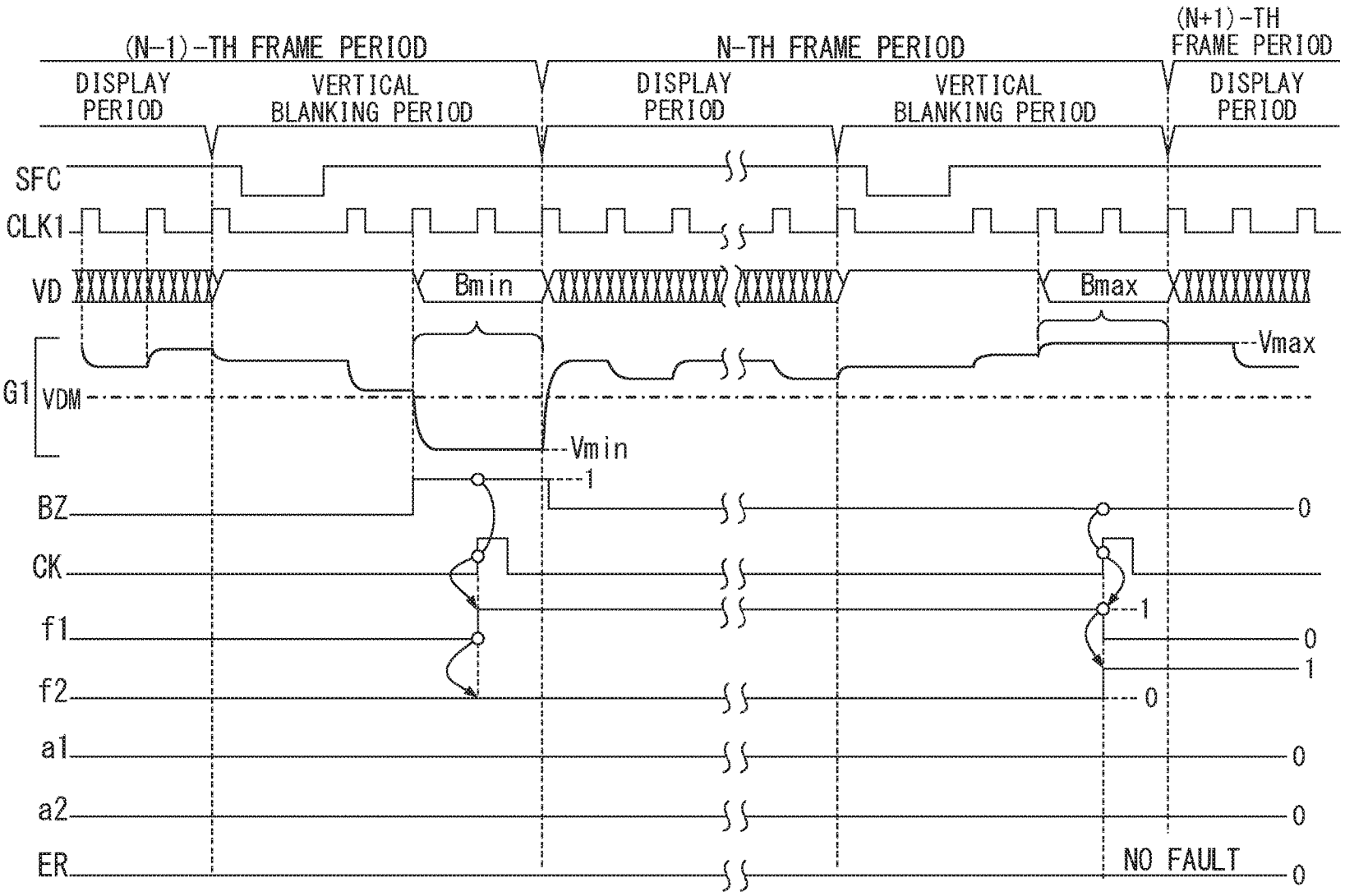
FIG. 11 is a timing chart illustrating other exemplary waveforms of various signals in the source driver and the fault detection circuit when the fault has not occurred in the source driver illustrated in FIG. 10.

The control part 140A supplies the video data signal VD, into which pixel data Bmin, Bmax for fault detection are incorporated, to the latch part 131 in response to the above-described vertical synchronization signal SFC during the respective vertical blanking periods of the (N−1)-th and the N-th frame periods as illustrated in FIG. 11. The pixel data Bmax is equivalent to pixel data that indicates, for example, the maximum luminance level in 8 bits, and the pixel data Bmin is equivalent to pixel data that indicates, for example, the minimum luminance level in 8 bits.

The control part 140A generates a clock signal CK as illustrated in FIG. 11 in synchronization with the vertical synchronization signal SFC, and supplies the clock signal CK to the fault detection circuit 141 similarly to the control part 140. The control part 140A generates a pulse-shaped signal, which transitions from the logic level 0 to the logic level 1 after the output of the pixel driving voltage G1 based on the pixel data Bmin (Bmax) for fault detection in each vertical blanking period as illustrated in FIG. 11, as the clock signal CK.

FIG. 11 is a timing chart illustrating exemplary waveforms of the respective signals in the source driver 13 and the fault detection circuit 141 illustrated in FIG. 10 when the fault has not occurred in the output part 133.

As illustrated in FIG. 11, when the fault has not occurred in the output part 133, the pixel driving voltage G1 varies in a range from the voltage value Vmin corresponding to the minimum luminance level to the voltage value Vmax corresponding to the maximum luminance level on the basis of the video data signal VD.

Therefore, the control part 140A first supplies the pixel data Bmin for fault detection indicating the minimum luminance level as the video data signal VD to the latch part 131 during the vertical blanking period (first vertical blanking period) of the (N−1)-th frame period as illustrated in FIG. 11. Then, the control part 140A supplies the pixel data Bmax for fault detection indicating the maximum luminance level as the video data signal VD to the latch part 131 during the vertical blanking period (second vertical blanking period) of the N-th frame period.

Thus, the value of the pixel driving voltage G1 generated corresponding to the pixel data Bmin becomes the minimum voltage value Vmin in the first vertical blanking period as illustrated in FIG. 11. The value of the pixel driving voltage G1 generated corresponding to the pixel data Bmax becomes the maximum voltage value Vmax in the second vertical blanking period as illustrated in FIG. 11. At this time, the threshold voltage VDM used in the binarization circuit 21 of the fault detection circuit 141 has the voltage value between the minimum voltage value Vmin and the maximum voltage value Vmax, which are possible as the pixel driving voltage.

Accordingly, the logic level of the binarized signal BZ obtained by binarizing the pixel driving voltage G1 with the threshold voltage VDM by the binarization circuit 21 becomes the logic level 1 in the first vertical blanking period and becomes the logic level 0 in the second vertical blanking period as illustrated in FIG. 11. Thus, the first signal f1 obtained by retrieving the binarized signal BZ at the timing of the clock signal CK in the second vertical blanking period by the FF 22 becomes the logic level 0. The second signal f2 obtained by retrieving the binarized signal BZ at the timing of the clock signal CK in the first vertical blanking period by the FF 23 becomes the logic level 1. That is, the first signal f1 and the second signal f2 become the mutually different logic levels. Therefore, at this time, since both the AND gate 24 and the NOR gate 25 output the logic level 0, the fault detection circuit 141 outputs the fault detection signal ER of the logic level 0 indicating "no fault."

Figure 12:
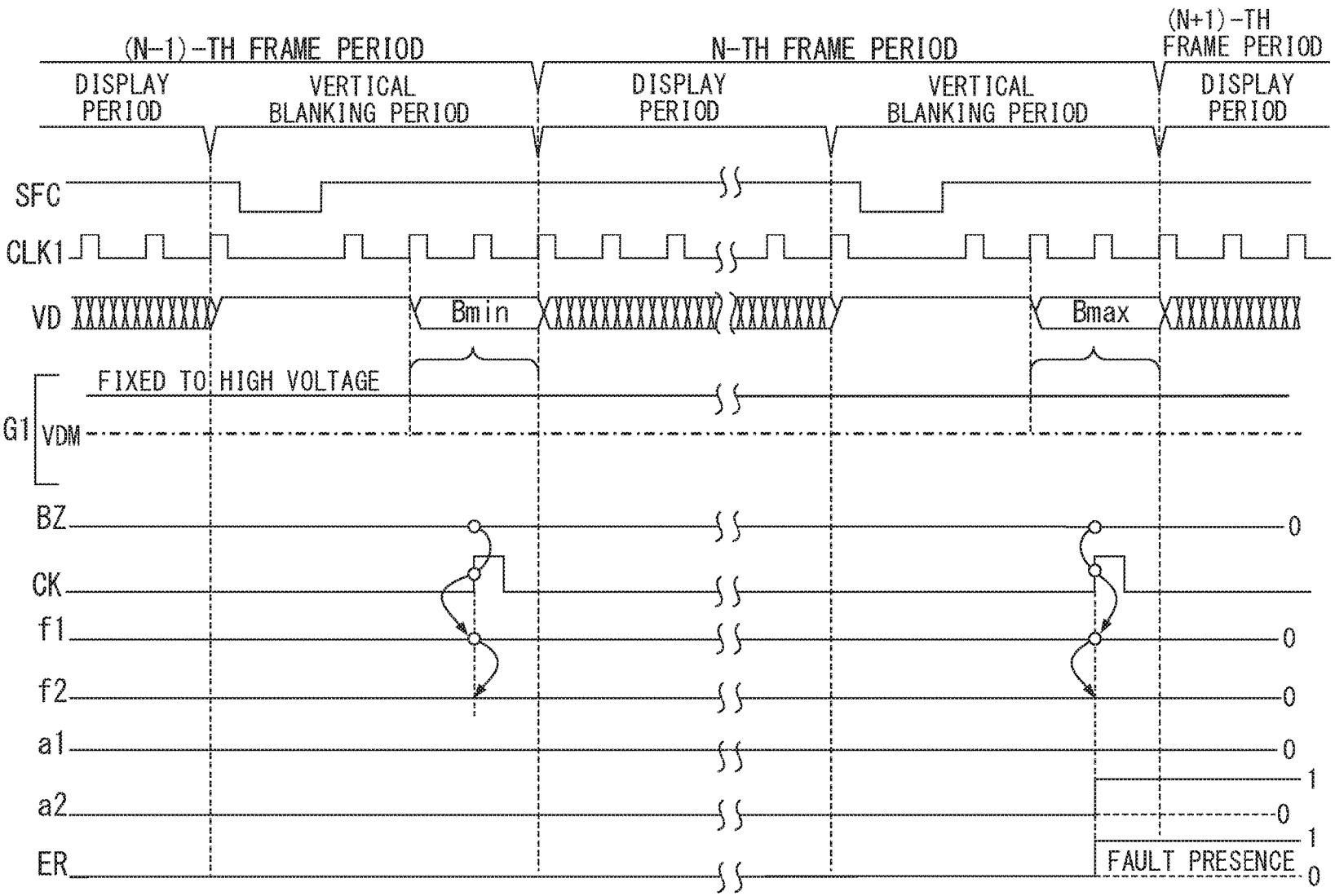
FIG. 12 is a timing chart illustrating exemplary waveforms of various signals in the source driver and the fault detection circuit when the fault in which the voltage value of the pixel driving voltage is fixed to a constant value of positive polarity has occurred in the source driver illustrated in FIG. 10.

FIG. 12 is a timing chart illustrating exemplary waveforms of the signals in the source driver 13 and the fault detection circuit 141 illustrated in FIG. 10 when a fault in which the pixel driving voltage G1 generated by the output part 133 is fixed to a constant voltage value higher than the threshold voltage VDM has occurred.

As illustrated in FIG. 12, when such a fault has occurred, the pixel driving voltage G1 has the voltage value higher than the threshold voltage VDM regardless of the video data signal VD. Therefore, the logic level of the binarized signal BZ obtained by binarizing the pixel driving voltage G1 with the threshold voltage VDM by the binarization circuit 21 is fixed to the state of the logic level 0 as illustrated in FIG. 12.

Accordingly, both the first signal f1 obtained by retrieving the binarized signal BZ at the timing of the clock signal CK in the second vertical blanking period by the FF 22 and the second signal f2 obtained by retrieving the binarized signal BZ at the timing of the clock signal CK in the first vertical blanking period by the FF 23 become the same logic level 0. Therefore, at this time, since the NOR gate 25 generates the fault determination signal a2 of the logic level 1, the fault detection circuit 141 outputs the fault detection signal ER of the logic level 1 indicating "presence of fault."

Figure 13:
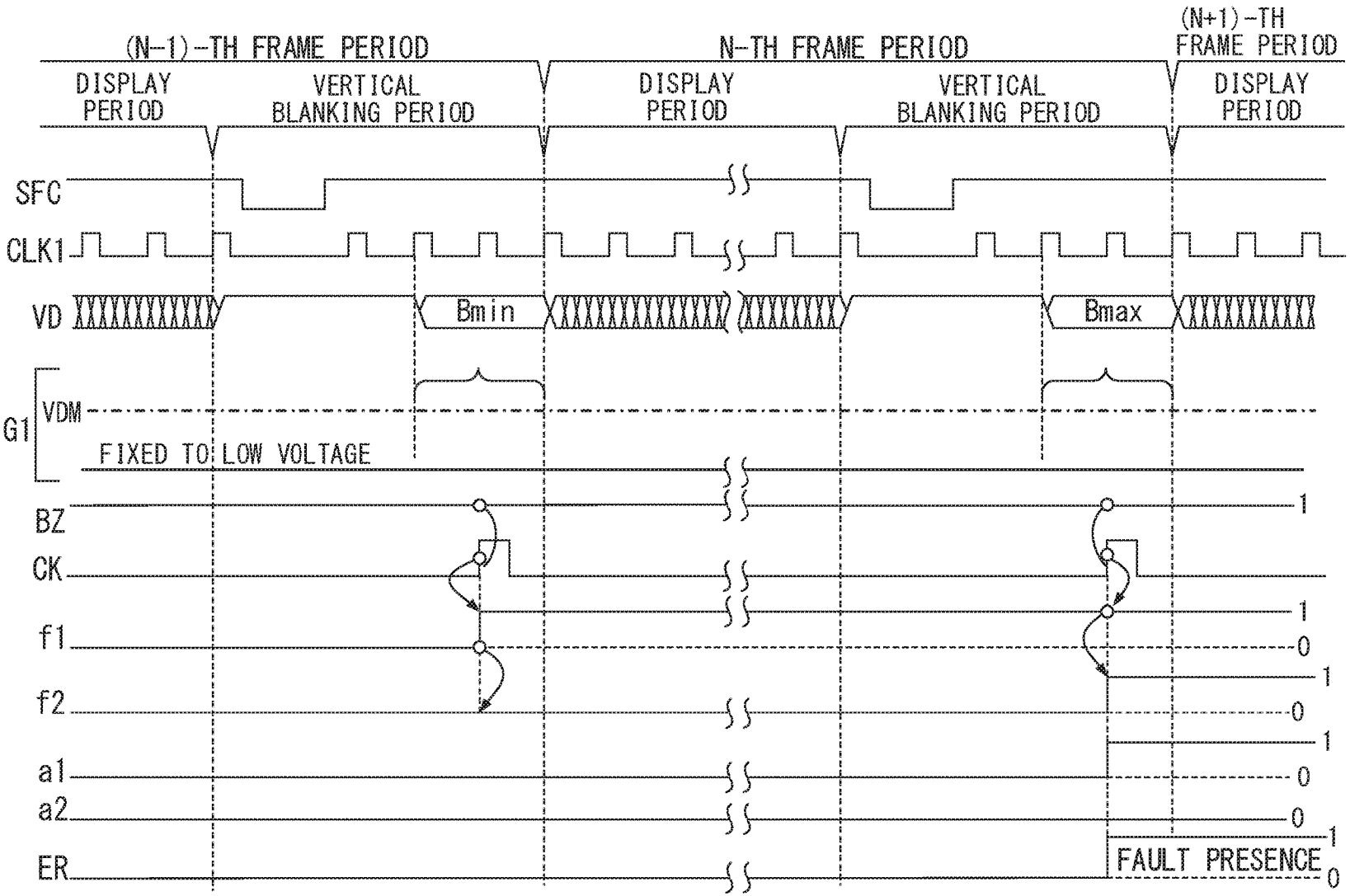
FIG. 13 is a timing chart illustrating exemplary waveforms of various signals in the source driver and the fault detection circuit when the fault in which the voltage value of the pixel driving voltage is fixed to a constant value of negative polarity has occurred in the source driver illustrated in FIG. 10.

FIG. 13 is a timing chart illustrating exemplary waveforms of the signals in the source driver 13 and the fault detection circuit 141 illustrated in FIG. 10 when a fault in which the pixel driving voltage G1 generated by the output part 133 is fixed to a constant voltage value lower than the threshold voltage VDM has occurred.

As illustrated in FIG. 13, when such a fault has occurred, the pixel driving voltage G1 has the voltage value lower than the threshold voltage VDM regardless of the video data signal VD. Therefore, the logic level of the binarized signal BZ obtained by binarizing the pixel driving voltage G1 with the threshold voltage VDM by the binarization circuit 21 is fixed to the state of the logic level 1 as illustrated in FIG. 13.

Accordingly, the first signal f1 obtained by retrieving the binarized signal BZ at the timing of the clock signal CK in the second vertical blanking period by the FF 22 becomes the logic level 1. The second signal f2 obtained by retrieving the binarized signal BZ at the timing of the clock signal CK in the first vertical blanking period by the FF 23 also becomes the logic level 1. That is, both the first signal f1 and the second signal f2 become the same logic level 1. Therefore, at this time, since the AND gate 24 generates the fault determination signal a1 of the logic level 1, the fault detection circuit 141 outputs the fault detection signal ER of the logic level 1 indicating "presence of fault."

Figure 14A:
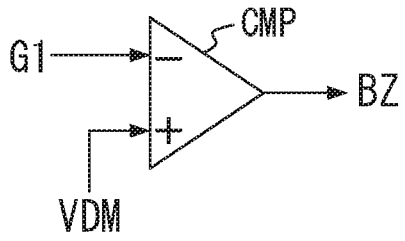
FIG. 14A is a drawing illustrating a comparator as a binarization circuit.
Figure 14B:
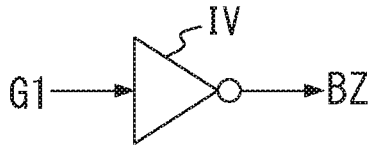
FIG. 14B is a drawing illustrating an inverter as a binarization circuit.

While the fault detection circuit 141 uses the binarization circuit 21 to binarize the pixel driving voltage G1 with the threshold voltage VDM in the above-described embodiment, for example, a comparator CMP as illustrated in FIG. 14A or an inverter circuit IV as illustrated in FIG. 14B may be used as the binarization circuit.

The comparator CMP illustrated in FIG. 14A generates the binarized signal BZ of the logic level 1 when the pixel driving voltage G1 received by an inverting input terminal is less than the threshold voltage VDM received by a non-inverting input terminal, and generates the binarized signal BZ of the logic level 0 when it is equal to or more than the threshold voltage VDM.

The inverter circuit IV illustrated in FIG. 14B includes an n-channel MOS type transistor and a p-channel MOS type transistor that have mutually connected gate terminals and mutually connected drain terminals. At this time, the n-channel MOS type transistor receives the pixel driving voltage G1 by its own gate terminal, becomes an ON state when the voltage value is equal to or more than the threshold voltage VDM, and outputs the binarized signal BZ of the logic level 0 from its own drain terminal. The p-channel MOS type transistor receives the pixel driving voltage G1 at its own gate terminal, becomes an ON state when the voltage value is less than the threshold voltage VDM, and outputs the binarized signal BZ of the logic level 1 from its own drain terminal.

In the example illustrated in FIG. 3 or FIG. 10, the fault detection circuit 141 is configured to receive the pixel driving voltage G1 output from the output part 133 at the inside of the source driver 13.

Figure 15:
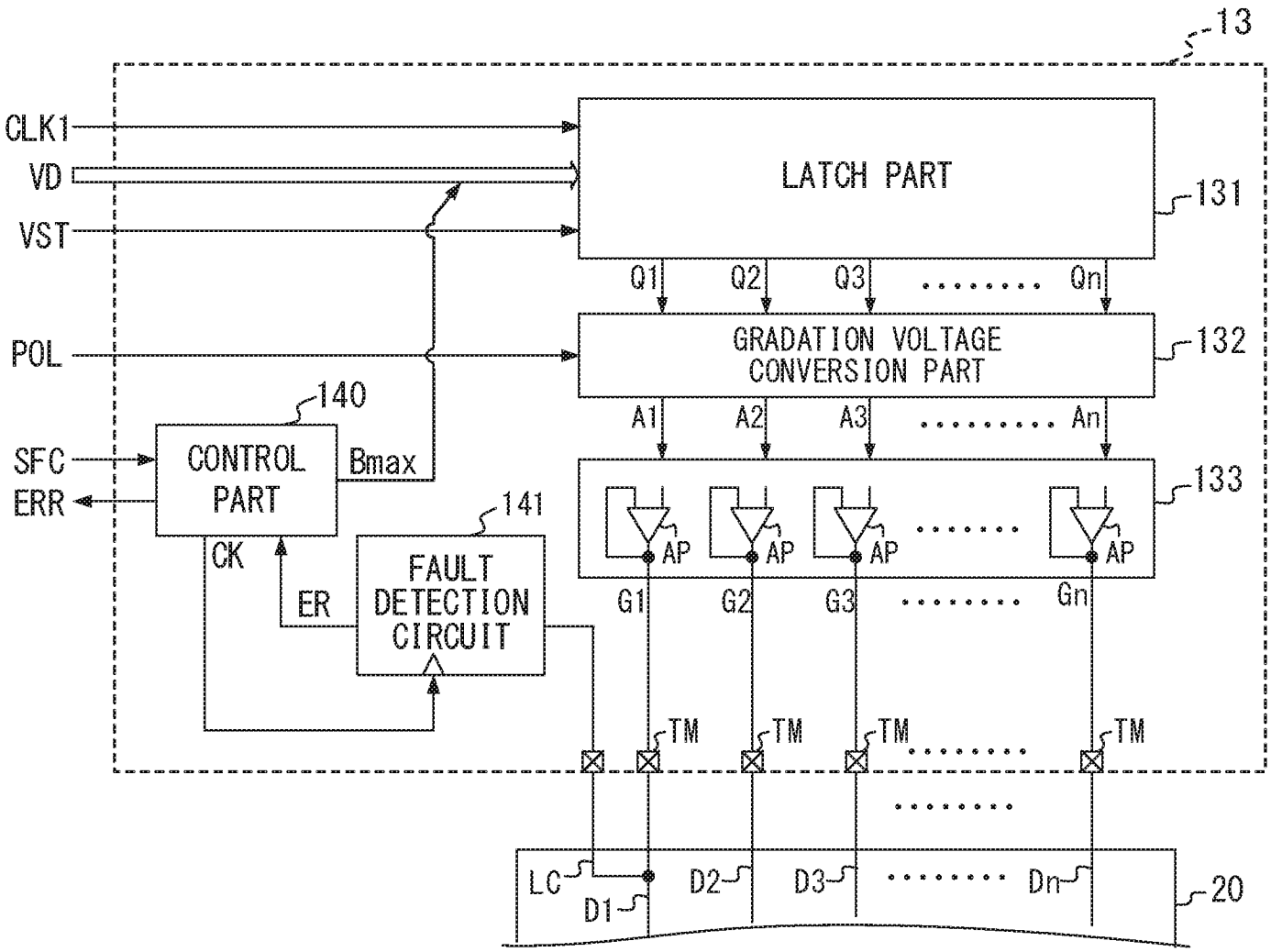
FIG. 15 is a block diagram illustrating another internal configuration of the source driver and a display panel.

However, a display panel that includes a wiring LC connected to a source line D1 inside the display panel illustrated as a display panel 20 in FIG. 15 may be employed, thus causing the fault detection circuit 141 to receive the pixel driving voltage G1 via the wiring LC. This configuration ensures detection of not only the fault of the gradation voltage conversion part 132 and the output part 133 but also a fault of disconnection in which a wiring connecting between the source driver 13 and the display panel 20 is broken by the fault detection circuit 141.

While the fault detection circuit 141 is configured to perform the fault detection based on the pixel driving voltage G1 among the pixel driving voltages G1 to Gn in the above-described embodiment, the fault detection circuit 141 may be configured to perform the fault detection based on the pixel driving voltage other than the pixel driving voltage G1. A plurality of the fault detection circuits 141 that individually receive all of the pixel driving voltages G1 to Gn or a plurality of two or more pixel driving voltages may be disposed to supply a result of a logical sum of the fault detection signals ER output from the respective fault detection circuits to the display controller 11.

In the above-described embodiment, the control part 140 generates the pixel driving voltage based on the pixel data piece (Bmax, Bmin) for fault detection in the vertical blanking period as the non-display period. Then, the fault detection circuit 141 is configured to perform the fault detection based on the pixel driving voltage generated in the vertical blanking period.

However, the generation of the pixel driving voltage based on fault detection data and the fault detection based on the generated pixel driving voltage may be performed in the non-display period other than the vertical blanking period, for example, immediately after turning on the power.

Basically, it is only necessary that the display driver (13) that generates the pixel driving voltage (G1 to Gn) on the bases of the video signal (VD) and supplies it to the display panel 20 includes the following control part (140) and fault detection circuit (141).

That is, the control part (140) sequentially incorporates the first pixel data piece (Bmax or Bmin) and the second pixel data piece (Bmax) for fault detection into the video signal during the non-display period (for example, vertical blanking period).

The fault detection circuit (141) binarizes each of the first pixel driving voltage (G1) output corresponding to the first pixel data piece for fault detection and the second pixel driving voltage (G1) output according to the second pixel data piece for fault detection with the predetermined threshold voltage (VDM) to obtain the first and the second signals (f1, f2). Then, the fault detection circuit (141) determines (24 to 26) whether the first signal (f1) and the second signal (f2) match and outputs the fault detection signal (ER) indicating the fault presence when they match.

It is understood that the foregoing description and accompanying drawings set forth the preferred embodiments of the present invention at the present time. Various modifications, additions and alternative designs will, of course, become apparent to those skilled in the art in light of the foregoing teachings without departing from the spirit and scope of the disclosed invention. Thus, it should be appreciated that the present invention is not limited to the disclosed Examples but may be practiced within the full scope of the appended claims. This application is based upon and claims the benefit of priority from the prior Japanese Patent Application No. 2019-158264 filed on Aug. 30, 2019, the entire contents of which are incorporated herein by reference.

What is claimed is:

1. A display driver configured to receive a video signal, generate pixel driving voltages, and output the pixel driving voltages to a display panel, the video signal including a series of pixel data pieces that indicate luminance levels of respective pixels, the pixel driving voltages corresponding to the pixel data pieces, the display driver comprising:

a control part configured to incorporate sequentially a first pixel data piece and a second pixel data piece for fault detection into the video signal; and a fault detection circuit configured to binarize each of a first pixel driving voltage and a second pixel driving voltage with a predetermined threshold voltage to obtain a first signal and a second signal, the first pixel driving voltage being output corresponding to the first pixel data piece, the second pixel driving voltage being output corresponding to the second pixel data piece, the fault detection circuit determining whether the first signal and the second signal match and outputting a fault detection signal that indicates a presence of a fault when the first signal and the second signal match, wherein the control part incorporates said first pixel data piece into a vertical blanking period in one frame period of mutually adjacent frame periods of the video signal, and incorporates said second pixel data piece into a vertical blanking period of another frame period, and the fault detection circuit binarizes each of the first pixel driving voltage and the second pixel driving voltage with the threshold voltage to obtain the first signal and the second signal, the first pixel driving voltage is output corresponding to the first pixel data piece included in the vertical blanking period of the one frame period, and the second pixel driving voltage is output corresponding to the second pixel data piece included in the vertical blanking period of the other frame period.

2. The display driver according to claim 1, wherein the pixel driving voltage has a polarity inverted from a positive polarity to a negative polarity or inverted from the negative polarity to the positive polarity in each frame period, and the threshold voltage has a voltage value at a boundary between a voltage of the positive polarity and a voltage of the negative polarity.

3. The display driver according to claim 2, wherein both the first pixel data piece and the second pixel data piece are data that indicate a maximum luminance level.

4. The display driver according to claim 1, wherein the first pixel data piece is data that indicates one luminance level of a maximum luminance level and a minimum luminance level, and the second pixel data piece is data that indicates another luminance level of the maximum luminance level and the minimum luminance level, and the threshold voltage has a voltage value corresponding to a luminance level between the maximum luminance level and the minimum luminance level.

5. A display device comprising:

a display driver configured to include a pixel driving voltage generation part, a control part, and a fault detection circuit: and a display panel to which pixel driving voltages are input, wherein the pixel driving voltage generation part generates the pixel driving voltages on the basis of a video signal, the video signal including a series of pixel data pieces that indicate luminance levels of respective pixels;

the control part sequentially incorporates a first pixel data piece and a second pixel data piece for fault detection into the video signal; and the fault detection circuit binarizes each of a first pixel driving voltage and a second pixel driving voltage with a predetermined threshold voltage to obtain a first signal and a second signal, the first pixel driving voltage being output corresponding to the first pixel data piece, the second pixel driving voltage being output corresponding to the second pixel data piece, the fault detection circuit determining whether the first signal and the second signal match and outputting a fault detection signal that indicates a presence of a fault when the first signal and the second signal match, wherein the control part incorporates said first pixel data piece into a vertical blanking period in one frame period of mutually adjacent frame periods of the video signal, and incorporates said second pixel data piece into a vertical blanking period of another frame period, and the fault detection circuit binarizes each of the first pixel driving voltage and the second pixel driving voltage with the threshold voltage to obtain the first signal and the second signal, the first pixel driving voltage is output corresponding to the first pixel data piece included in the vertical blanking period of the one frame period, and the second pixel driving voltage is output corresponding to the second pixel data piece included in the vertical blanking period of the other frame period.

6. A semiconductor device comprising a display driver configured to receive a video signal, generate pixel driving voltages, and output the pixel driving voltages to a display panel, the video signal including a series of pixel data pieces that indicate luminance levels of respective pixels, the pixel driving voltages corresponding to the pixel data pieces, wherein the display driver includes:

a control part configured to incorporate sequentially a first pixel data piece and a second pixel data piece for fault detection into the video signal; and a fault detection circuit configured to binarize each of a first pixel driving voltage and a second pixel driving voltage with a predetermined threshold voltage to obtain a first signal and a second signal, the first pixel driving voltage being output corresponding to the first pixel data piece, the second pixel driving voltage being output corresponding to the second pixel data piece, the fault detection circuit determining whether the first signal and the second signal match and outputting a fault detection signal that indicates a presence of a fault when the first signal and the second signal match, wherein the control part incorporates said first pixel data piece into a vertical blanking period in one frame period of mutually adjacent frame periods of the video signal, and incorporates said second pixel data piece into a vertical blanking period of another frame period, and the fault detection circuit binarizes each of the first pixel driving voltage and the second pixel driving voltage with the threshold voltage to obtain the first signal and the second signal, the first pixel driving voltage is output corresponding to the first pixel data piece included in the vertical blanking period of the one frame period, and the second pixel driving voltage is output corresponding to the second pixel data piece included in the vertical blanking period of the other frame period.

* * * * *